US011243040B2

(12) United States Patent
Honigmann et al.

(10) Patent No.: US 11,243,040 B2
(45) Date of Patent: Feb. 8, 2022

(54) RECOIL BOOSTER FOR FIREARM SUPPRESSOR

(71) Applicant: SureFire, LLC, Fountain Valley, CA (US)

(72) Inventors: Karl R. Honigmann, Anaheim Hills, CA (US); Barry W. Dueck, Fullerton, CA (US)

(73) Assignee: SureFire, LLC, Fountain Valley, CA (US)

( * ) Notice: Subject to any disclaimer, the term of this patent is extended or adjusted under 35 U.S.C. 154(b) by 166 days.

(21) Appl. No.: 16/407,127

(22) Filed: May 8, 2019

(65) Prior Publication Data

US 2020/0232740 A1 Jul. 23, 2020

Related U.S. Application Data

(60) Provisional application No. 62/794,495, filed on Jan. 18, 2019.

(51) Int. Cl.
*F41A 21/30* (2006.01)
*F41A 21/26* (2006.01)

(52) U.S. Cl.
CPC ..... *F41A 21/30* (2013.01); *F41A 21/26* (2013.01)

(58) Field of Classification Search
CPC ..... F41A 21/26; F41A 21/30; F41A 21/32; F41A 21/325
See application file for complete search history.

(56) References Cited

U.S. PATENT DOCUMENTS 3,677,132 A * 7/1972 Plenge ..... F41A 35/02 89/14.2
5,559,302 A * 9/1996 Latka ..... F41A 21/325 89/14.05
5,685,102 A * 11/1997 Latka ..... F41A 21/325 42/76.01
7,905,171 B1 * 3/2011 Brittingham ..... F41A 21/30 89/36.08
8,272,306 B1 * 9/2012 Smith ..... F41A 21/30 89/14.4

(Continued)

OTHER PUBLICATIONS

"Muzzle Booster", Wikipedia, Dec. 18, 2018, 5 pages [online], [retrieved on May 8, 2019], Retrieved from the internet <URL:http://en.wikipedia.org/wiki/Muzzle__Booster>.

*Primary Examiner* — Derrick R Morgan
(74) *Attorney, Agent, or Firm* — Haynes and Boone, LLP

(57) ABSTRACT

A firearm suppressor with a recoil booster may be provided. In one example, the suppressor may include a housing, a back end member coupled to the housing, and a recoil booster coupled to the back end member. The recoil booster may be configured to couple to a firearm. The recoil booster may include a coil spring, a rear cap coupled to the back end member, and a piston configured to slide relative to the rear cap. The rear cap may include a main body at least partially disposed within the back end member and including a first bearing surface to receive a first end of the spring and a flange extending forward from the main body and maintained within an inner circumference of the spring. The piston may include a second bearing surface configured to receive a second end of the spring. Additional embodiments and related methods are provided.

18 Claims, 16 Drawing Sheets

(56) References Cited

U.S. PATENT DOCUMENTS

| | | | | |
|---|---|---|---|---|
| 8,387,299 | B1 * | 3/2013 | Brittingham | F41A 21/325 42/90 |
| 8,424,441 | B2 * | 4/2013 | Brittingham | F41A 21/26 89/14.4 |
| 8,910,746 | B1 * | 12/2014 | McKenzie | F41A 21/30 181/223 |
| 9,115,950 | B2 * | 8/2015 | Bethlenfalvy | F41A 21/30 |
| 9,121,656 | B1 * | 9/2015 | McKenzie | F41A 21/325 |
| 10,054,384 | B1 * | 8/2018 | Marfione | F41A 21/30 |
| 10,184,745 | B1 * | 1/2019 | Fulton | F41A 21/30 |
| 10,281,228 | B1 * | 5/2019 | Marfione | F41A 21/30 |
| 10,480,884 | B2 * | 11/2019 | Smith | F41A 21/30 |
| 10,852,091 | B1 * | 12/2020 | Helms | F41A 21/30 |
| 2006/0060076 | A1 * | 3/2006 | Dueck | F41A 21/30 89/14.4 |
| 2009/0050403 | A1 * | 2/2009 | Brittingham | F41A 21/30 181/223 |
| 2011/0036233 | A1 * | 2/2011 | DeGroat | F41A 21/325 89/14.4 |
| 2011/0067950 | A1 * | 3/2011 | Shults | F41A 21/30 181/223 |
| 2014/0353076 | A1 * | 12/2014 | Bethlenfalvy | F41A 21/30 181/223 |
| 2016/0018179 | A1 * | 1/2016 | Morris | F41A 21/30 181/223 |
| 2016/0084602 | A1 * | 3/2016 | Smith | F41A 21/325 89/14.4 |
| 2016/0209151 | A1 * | 7/2016 | Smith | F41A 21/30 |
| 2017/0205176 | A1 * | 7/2017 | Whitson | F41A 21/325 |
| 2018/0106569 | A1 * | 4/2018 | Smith | F41A 21/30 |
| 2018/0172383 | A1 * | 6/2018 | James | F41A 21/30 |
| 2018/0292164 | A1 * | 10/2018 | Thompson | F41A 21/36 |
| 2020/0149836 | A1 * | 5/2020 | DeJessa | F41A 21/325 |
| 2020/0370852 | A1 * | 11/2020 | Marcotte | F41A 21/482 |

* cited by examiner

RECOIL BOOSTER FOR FIREARM SUPPRESSOR

CROSS-REFERENCE TO RELATED APPLICATIONS

This application claims the benefit of U.S. Provisional Patent Application No. 62/794,495 filed Jan. 18, 2019 and entitled "RECOIL BOOSTER FOR FIREARM SUPPRESSOR" which is hereby incorporated by reference in its entirety.

TECHNICAL FIELD

This disclosure relates to firearms in general, and more particularly to suppressors for firearms.

BACKGROUND

Firearms, such as pistols or rifles, utilize expanding high-pressure gases generated by a burning propellant to expel a projectile from the weapon at a relatively high velocity. When the projectile, or bullet, exits the muzzle end of the weapon's barrel, a bright, "muzzle flash" of light and a high-pressure pulse of combustion gases accompany it. The rapid pressurization and subsequent depressurization caused by the high-pressure pulse gives rise to a loud sound known as "muzzle blast," which, like muzzle flash, can readily indicate both the location of the weapon and the direction from which it is being fired. In some situations, it is desirable to minimize or eliminate the muzzle blast by suppressing the flash and/or eliminating or substantially reducing the amplitude of the muzzle blast.

Sound suppressors operate to reduce muzzle blast by reducing and controlling the energy level of the propellant gases accompanying the projectile as it leaves the muzzle end of the weapon. These devices typically include a tubular housing that includes chambers with features configured to control the flow of gases to reduce the noise produced by the propellant gases. The rear end (e.g., the end of the suppressor closer to the firearm) of such suppressors typically include a mechanism for removably attaching the device to the weapon. However, such sound suppressors can add weight to the end of the muzzle of the firearm. The weight of the sound suppressor may interfere with operation of the firearm as well as increase the effects of recoil. Reducing such effects is desirable.

SUMMARY

In one embodiment, a firearm suppressor may be provided. The firearm suppressor may include a housing, a back end member coupled to the housing, and a recoil booster coupled to the back end member. The recoil booster may be configured to couple to a firearm. The recoil booster may include a coil spring, a rear cap coupled to the back end member, and a piston configured to slide relative to the rear cap. The rear cap may include a main body at least partially disposed within the back end member and including a first bearing surface to receive a first end of the spring and a flange extending forward from the main body and maintained within an inner circumference of the spring. The piston may include a second bearing surface configured to receive a second end of the spring.

In another embodiment, a method of operating a firearm sound suppressor may be provided. The method may include receiving a force from a firearm with a piston of a recoil booster of the firearm sound suppressor, sliding the piston, relative to a rear cap of the recoil booster, from a first position to a second position to compress a coil spring of the recoil booster, and returning the piston to the first position with force from the compressed coil spring. The firearm sound suppressor may include a housing, a back end member coupled to the housing, and the recoil booster coupled to the back end member and coupled to a firearm. The recoil booster may include a coil spring, a rear cap coupled to the back end member and including a main body at least partially disposed within the back end member, and a flange extending forward from the main body and maintained within an inner circumference of the spring, where the main body includes a first bearing surface to receive a first end of the spring, and the piston configured to slide relative to the rear cap and including a second bearing surface configured to receive a second end of the spring.

In a further embodiment, a method of manufacturing a firearm sound suppressor may be provided. The method may include providing a housing, coupling a back end member to the housing, and coupling a recoil booster to the back end member. The recoil booster may be configured to couple to a firearm. The recoil booster may include a coil spring, a rear cap coupled to the back end member and including a main body at least partially disposed within the back end member and including a first bearing surface to receive a first end of the spring, and a flange extending forward from the main body and maintained within an inner circumference of the spring, and a piston configured to slide relative to the rear cap and including a second bearing surface configured to receive a second end of the spring.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

In accordance with various embodiments provided herein, a recoil booster for a firearm sound suppressor may be provided. The firearm sound suppressor may be implemented to mount to an end of a barrel of a firearm. The firearm sound suppressor may be configured to reduce muzzle blast and/or muzzle flash of a firearm and may include the recoil booster.

Certain firearms may include a barrel and slide assembly that may recoil upon firing. In some cases, the recoil of the barrel and slide assembly may operate to unlock the barrel from the slide. As the firearm is configured to operate with a given weight of the barrel and slide, coupling a suppressor that does not include a recoil booster may prevent the firearm from operating properly.

In certain embodiments, the firearm sound suppressor described herein may include a recoil booster. The recoil booster may be used for firearms that include a barrel and slide assembly. A suppressor with a recoil booster may allow for the firearm to operate properly. The recoil booster may allow for the weight of the suppressor to be uncoupled from the barrel (e.g., during firing of the firearm). Uncoupling the weight of the suppressor from the barrel may temporarily decrease the effective attached weight of the suppressor, allowing the barrel to recoil. Various embodiments of recoil booster equipped firearm sound suppressors may be described herein.

Figure 1:
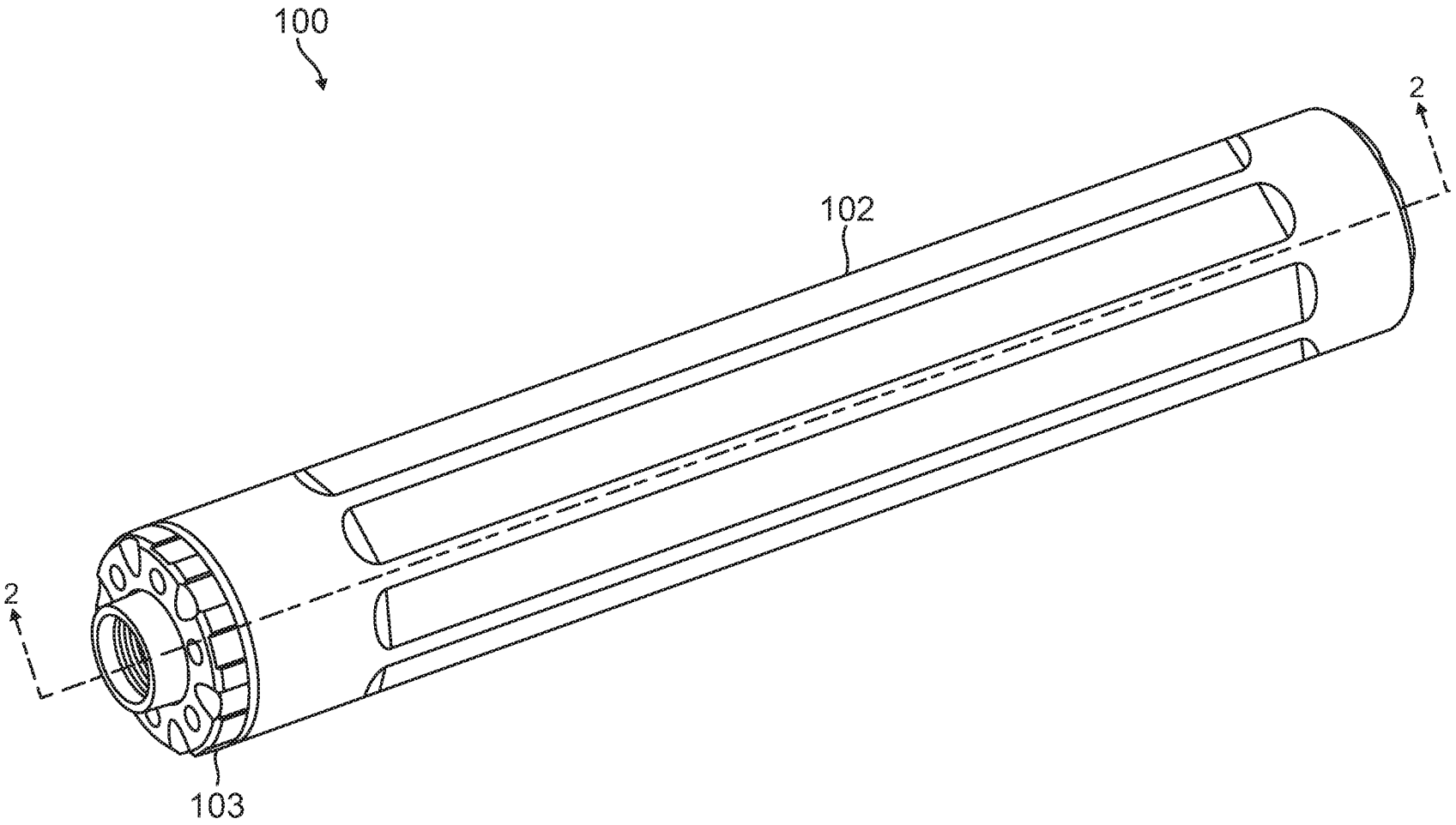
FIGS. 1-2B illustrate views of a firearm sound suppressor in accordance with embodiments of the disclosure.
Figure 2A:
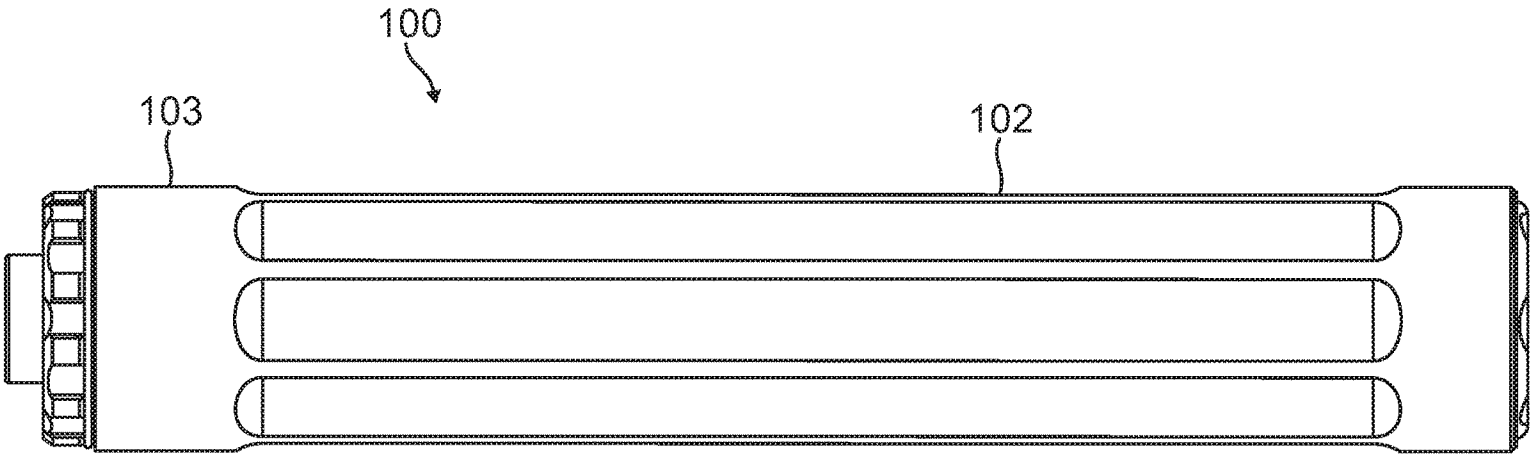
Figure 2B:
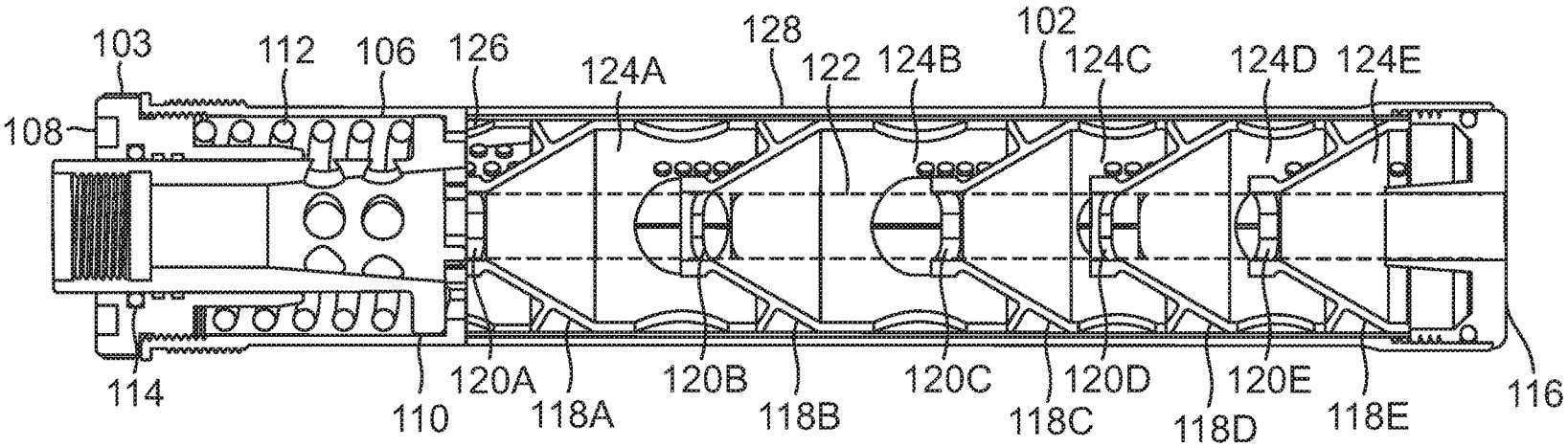
Figure 3:
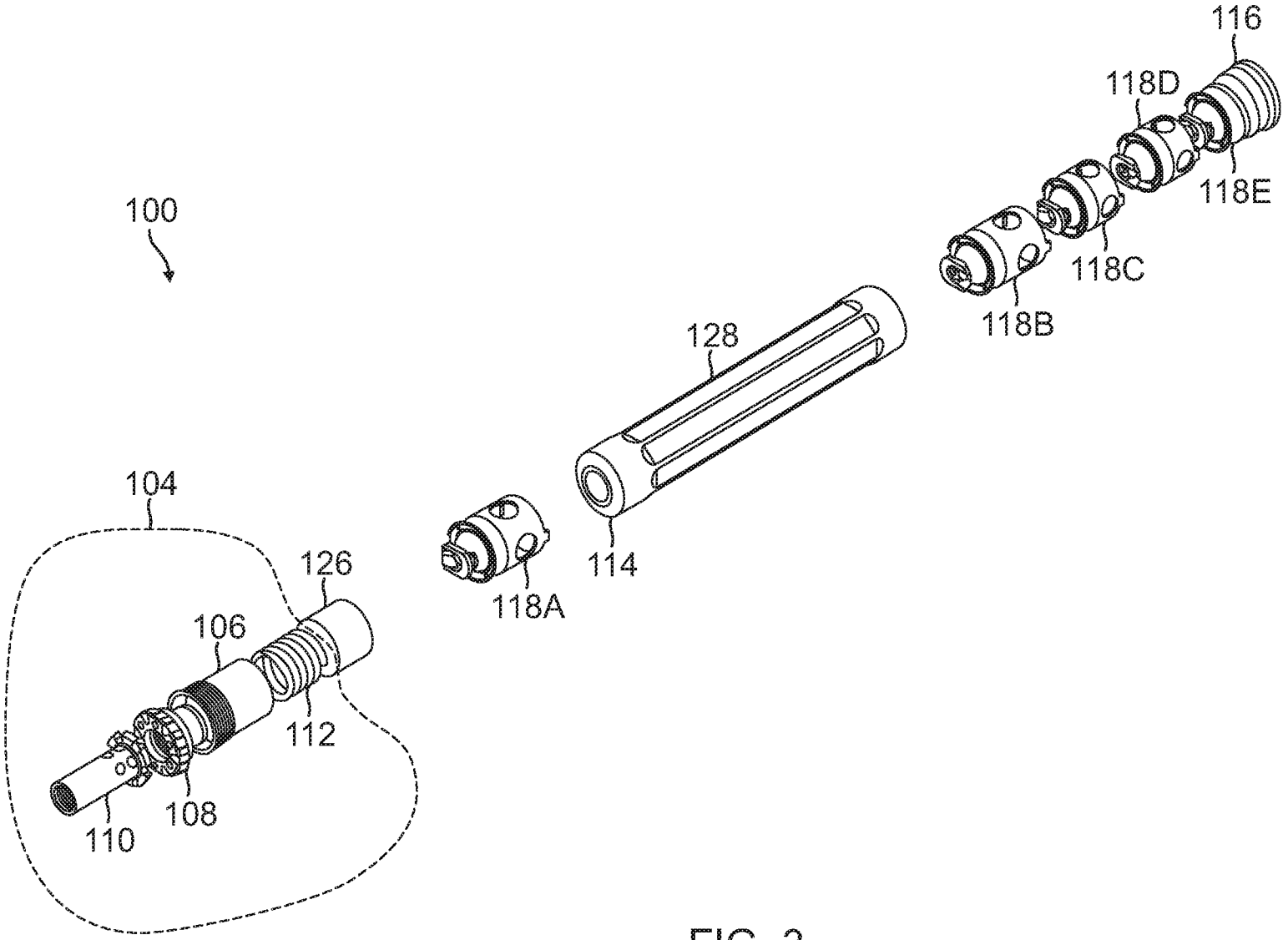
FIG. 3 illustrates an exploded view of a firearm sound suppressor in accordance with an embodiment of the disclosure.

Referring now to the drawings, wherein the drawings are for purposes of illustrating embodiments of the present invention only and not for purposes of limiting the same, FIGS. 1-2B illustrate views of a firearm sound suppressor in accordance with embodiments of the disclosure. FIG. 3 illustrates an exploded view of a firearm sound suppressor in accordance with an embodiment of the disclosure. Suppressor 100 illustrated may include housing 102 and rear assembly 103. For the purposes of this disclosure, a forward portion of the suppressor 100, or component thereof, may be a portion closer to the muzzle (e.g., where a bullet would exit). Conversely, a rearward portion may be a portion closer to where the bullet would enter the suppressor 100.

FIG. 1 and FIG. 2A illustrate an isometric and a side view of suppressor 100, respectively. FIG. 2B illustrates a side cross-sectional view, taken at line 2-2 in FIG. 1, of suppressor 100. As shown in FIG. 2B, suppressor 100 may include housing 102 and rear assembly 103. Housing 102 may include an outer shell 128 and one or more baffles 118A-E disposed within outer shell 128. The baffles 118A-E may include central apertures 120A-E. Central apertures 120A-E may be disposed coaxially within the housing 102 along an axis. Central apertures 120A-E may collectively define an interrupted central lumen 122 within the housing 102 through which a projectile (not illustrated) may travel when fired through the suppressor 100.

The baffles 118A-E may be arranged in a longitudinal "stack," which can include a plurality of individual baffles separated by spacers (e.g., spacer 126), individual baffles with integral spacers, or a stack of baffles that are formed integrally with each other during their manufacturing process. Various ones or pairs of baffles 118A-E may partially or collectively define a series of combustion gas expansion chambers 124A-E. Baffles 118A-E and/or combustion gas expansion chambers 124A-E may affect and/or control the energy level of the propellant gases accompanying the projectile as it leaves the muzzle end of the suppressor 100 (e.g., at end plate 116) and, accordingly, reduce the amount of muzzle blast and/or muzzle flash.

Rear assembly 103 may include a back end member 106 and a recoil booster. The recoil booster (shown as recoil booster 104 in FIG. 3) may include rear cap 108, piston 110, and coil spring 112. Back end member 106 may be coupled to housing 102 by, for example, including threads that are configured to engage complimentary threads of outer shell 128. Though the current disclosure may refer to coupling through threading, it is appreciated that other embodiments may couple through other techniques, such as through adhesives, mechanical fasteners, friction fits, or other such techniques.

The recoil booster 104 may be configured to couple to back end member 106. Thus, for example, rear cap 108 may be threaded into back end member 106. Accordingly, rear cap 108 and back end member 106 may each include corresponding threads configured to engage each other. The rear cap 108 may include at least a main body and a flange. The coil spring 112 may be received by (e.g., the coil spring 112 may be seated on), at least, a first bearing surface of the main body. The flange may be extend forward from the main body. At least a portion of the flange may be disposed within an inner circumference of the coil spring 112.

The piston 110 may be configured to slide relative to the rear cap 108. The piston 110 may include a second bearing surface (e.g., another bearing surface) configured to receive a second end of the spring. In certain embodiments, the flange of the rear cap 108 may be at least partially configured to separate at least a portion of the coil spring 112 from a longitudinal surface of the piston. The flange may allow for a greater bearing surface for the interface between the rear cap 108 and the piston 110, improving the stability of the piston 110 and, thus, the recoil booster 104 before and during the firing of the firearm.

In certain embodiments, a seal 114 may be disposed between the rear cap 108 and the piston 110. The seal 114 may be disposed within a groove of the rear cap 108 and/or a groove of the piston 110. Additionally, one or more voids may also be disposed between the rear cap 108 and the piston 110 to improve operation of the suppressor 100.

Figure 4:
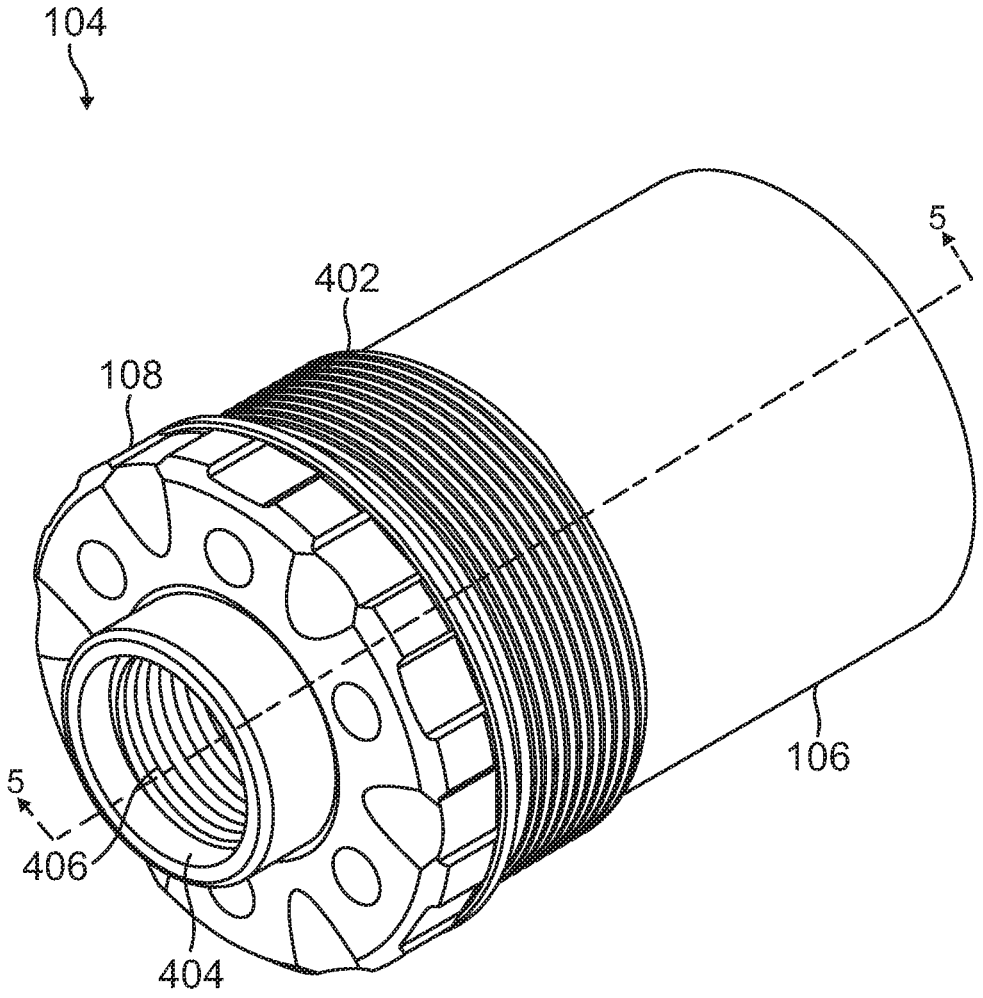
FIG. 4 illustrates a view of a portion of a firearm sound suppressor including a recoil booster in accordance with an embodiment of the disclosure.

FIG. 4 illustrates a view of a portion of a firearm sound suppressor including a recoil booster in accordance with an embodiment of the disclosure. FIG. 4 illustrates back end member 106 and recoil booster 104. Back end member 106 may include threads 402. Threads 402 may be configured to engage corresponding threads of outer shell 128. Rearward of the threads 402 may be a ridge for the outer shell 128 to bottom against.

Figure 5:
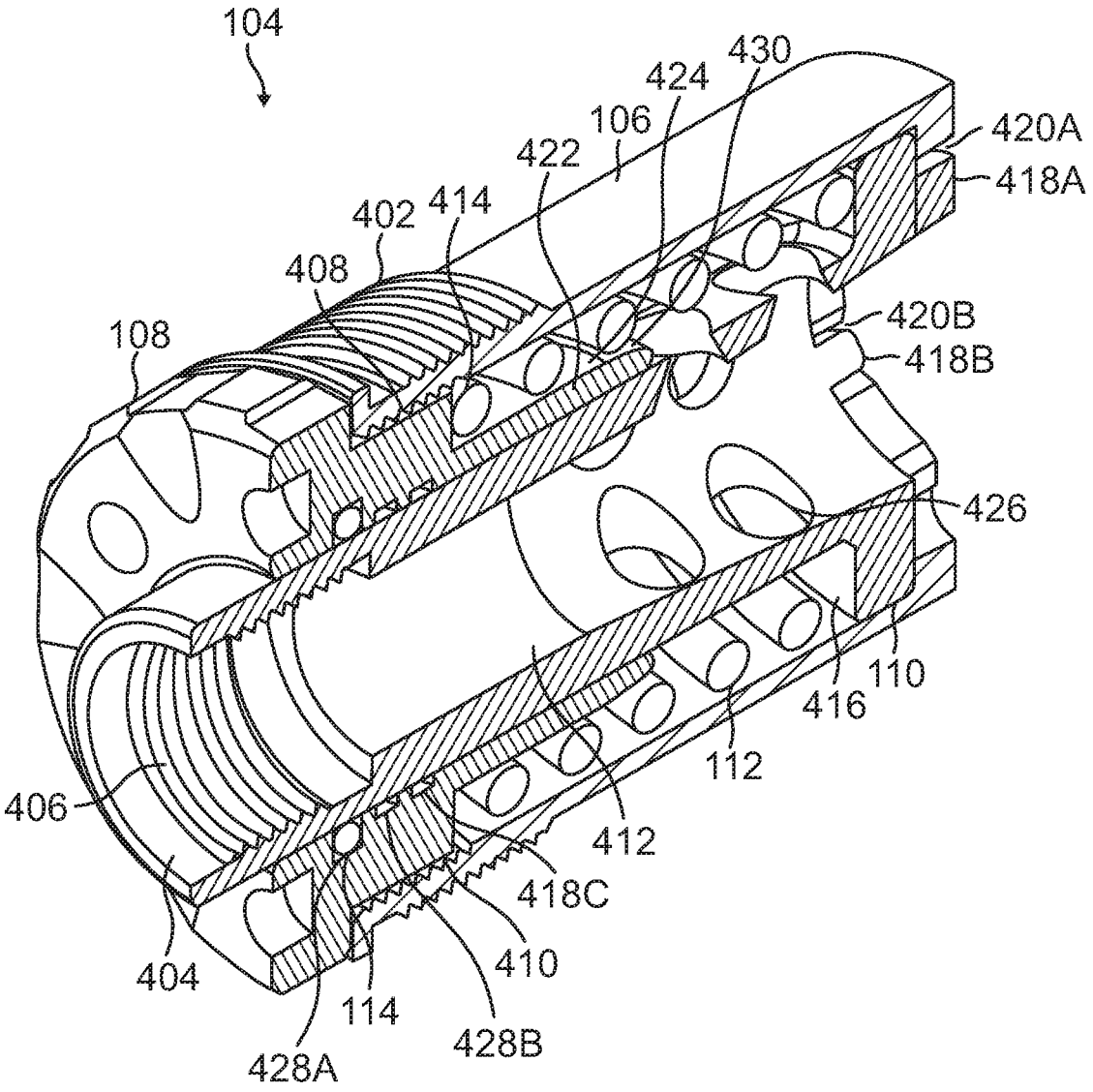
FIGS. 5-7 illustrate cross-sectional views of a portion of a firearm sound suppressor including a recoil booster, taken at line 5-5 of FIG. 4, in accordance with embodiments of the disclosure.
Figure 6:
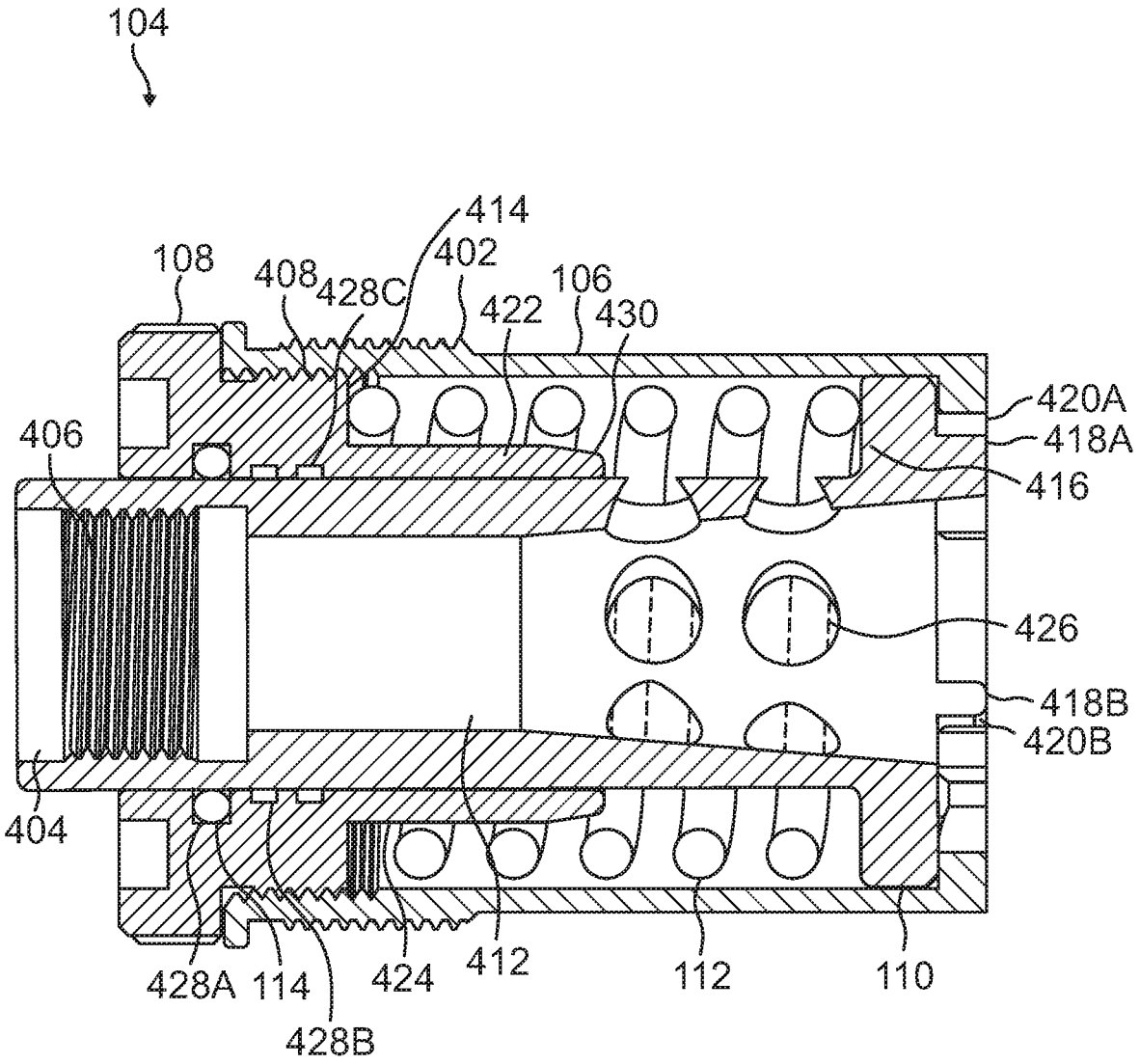
Figure 7:
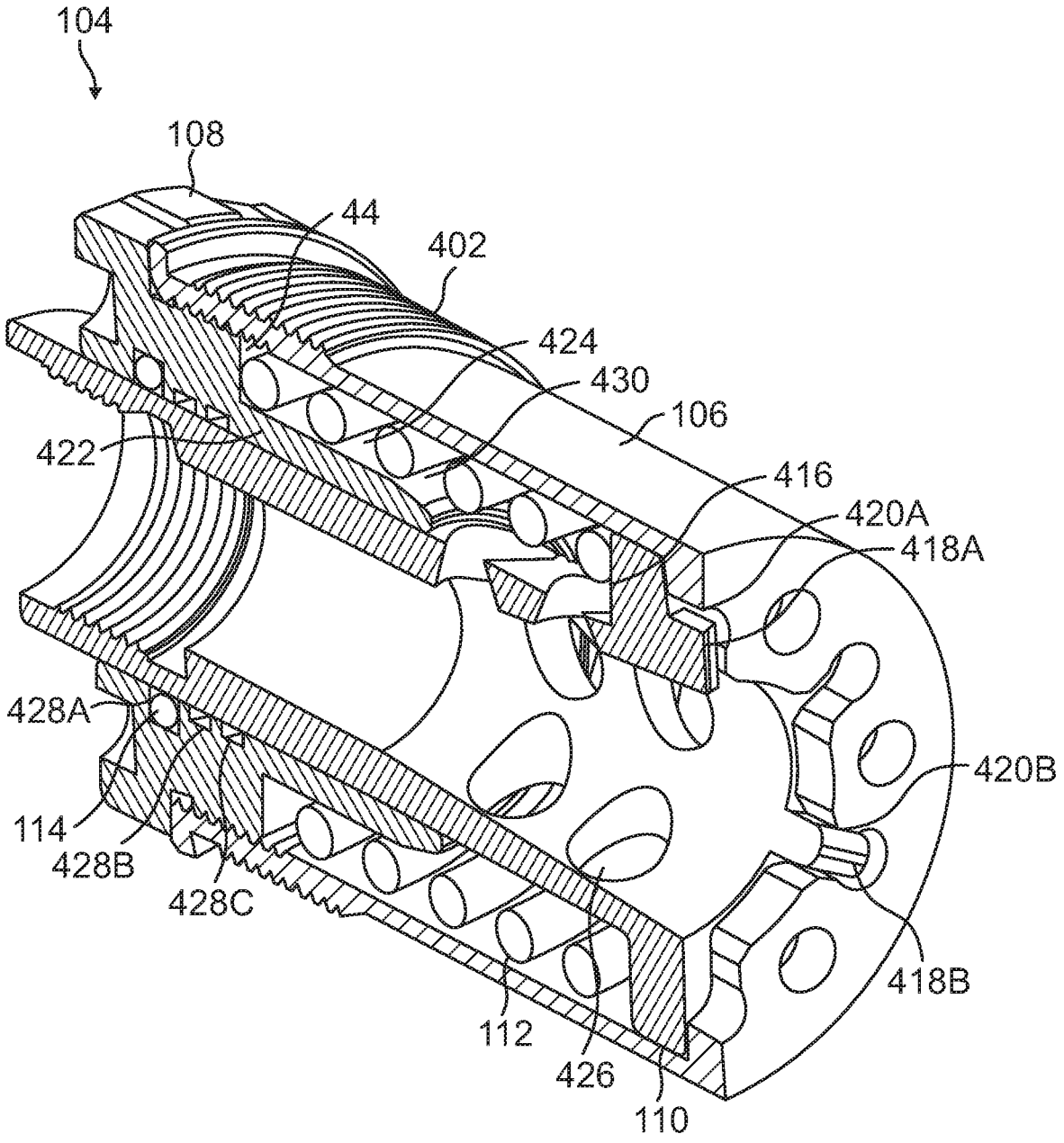

FIGS. 5-7 illustrate cross-sectional views of a portion of a firearm sound suppressor including a recoil booster, taken at line 5-5 of FIG. 4, in accordance with embodiments of the disclosure. As shown, piston 110 may include an opening 404 configured to receive a portion of a muzzle of a firearm.

Opening 404 may include threads 406. Threads 406 may be threaded onto corresponding threads of an attachment of the firearm and/or the firearm itself to attach the suppressor 100 to the firearm.

Back end member 106 may additionally include threads 410. Threads 410 may be configured to engage threads 408 of rear cap 108 to couple back end member 106 to rear cap 108. Flange 422 of rear cap 108 may be disposed on a portion of the rear cap 108 that is of a first diameter. Threads 408 may be disposed on a portion of rear cap 108 that is a second diameter. The second diameter may be larger than the first diameter. Rear cap 108 may additionally include a portion that is a third diameter larger than the second diameter. Back end member 106 may thus be threaded onto rear cap 108 and bottom against the third portion.

As shown, coil spring 112 may be disposed between portions of the back end member 106 and the rear cap 108 (e.g., the flange 422 of the rear cap 108) and/or the piston 110. The coil spring 112 may be disposed within a lumen defined by the portions of the back end member 106 and the rear cap 108 and/or the piston 110. The coil spring 112 may bottom against surface 414 of the rear cap 108 and surface 416 of the piston 110. Surfaces 414 and 416 may be substantially (e.g., within 5% of the standard) flat surfaces to allow for positive bottoming of the coil spring 112. Additionally, the piston 110 may include the surface 434 on a forward end of the piston 110. The surface 434 may be configured to bottom against a surface of the back end member 106 to prevent the piston 110 from moving further forward and, thus, provide a preload to the coil spring 112.

During firing, gases from the firing produce a force to move at least a portion of the suppressor 100 (e.g., the portions of the suppressor 100 excluding the piston 110 and/or the coil spring 112) forward relative to the barrel of the firearm. Thus, the forces may move the piston 110 to a second position relative to the rear cap 108 from a starting first position. The coil spring 112 may compress to temporarily decouple at least a portion of the suppressor 100 from the firearm. Thus, the weight of the suppressor 100 may be temporarily decoupled from the firearm, allowing for the firearm (e.g., the barrel and slide of the firearm) to function properly. The coil spring 112 may then return the suppressor to the original position after firing and, thus, the piston 110 may be moved back to the first position relative to the rear cap 108.

In certain embodiments, the flange 422 may extend outward from a body of the rear cap 108 and may be disposed within an interior of the coil spring 112 (e.g., within an inner radius and/or diameter of the coils of the coil spring 112). The flange 422 may include a first flange portion 424 and a second flange portion 430. The first flange portion 424 may be substantially straight. The second flange portion 430 may be sloped and may be disposed forward of the first flange portion 424. The slope of the second flange portion 430 may be configured to guide a portion of the coil spring 112 over the flange 422 as the coil spring 112 compresses in response to a firing of the firearm, allowing for smoother operation and improved positioning of the coil spring 112. Additionally, the flange 422 may extend over the piston 110. The larger bearing surface due to the flange 422 may further improve positioning of the piston 110 relative to the rear cap 108. Thus, central aperture 412 of the piston 110, which is configured to allow for a bullet to pass, may be better aligned with central lumen 122, improving the accuracy of the firearm.

The piston 110 may additionally include tabs 418A-B. The back end member 106 may include openings 420A-B. The openings 420A-B may be configured to receive the tabs 418A-B to position piston 110 relative to the back end member 106. As the firearm is coupled to the piston 110, the tabs 418A-B may be inserted into the openings 420A-B to orient the suppressor 100 relative to the firearm.

The piston 110 may additionally include one or more apertures 426. The apertures 426 may be configured to allow gases to pass between the central aperture 412 and the lumen where the coil spring 112 is disposed within. Thus, combustions gases may pass from the central aperture 412 to the lumen, lessening the shock and/or noise produced by the firing of the firearm.

In certain embodiments, the rear cap 108 and/or the piston 110 may include one or more openings (e.g., apertures, slots, channels, and/or other types of openings). For example, openings 428A-C may be formed within the rear cap 108. The openings 428A-C may be configured to receive one or more seals or gaskets or may be voids (e.g., to provide one or more labyrinth seals). Thus, opening 428A may be configured to receive the seal 114. In some embodiments, openings 428B and 428C may be air pockets configured to allow for the piston 110 to more easily slide relative to the rear cap 108 (e.g., by creating an air pocket and/or by allowing for thermal expansion of either or both of the piston 110 and the rear cap 108).

Figure 8:
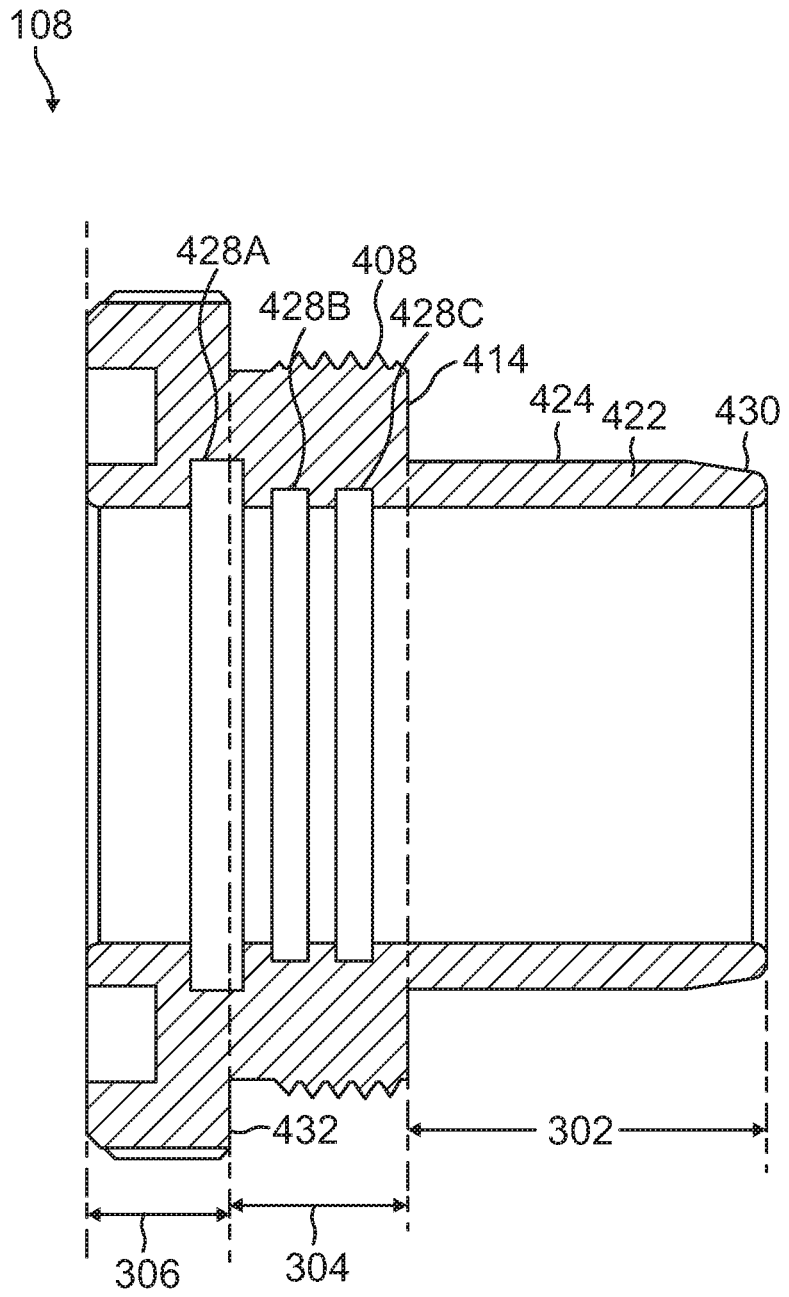
FIG. 8 illustrates a cross-sectional view of a rear cap of a recoil booster, taken at line 5-5 of FIG. 4, in accordance with an embodiment of the disclosure.

FIG. 8 illustrates a cross-sectional view of a rear cap of a recoil booster, taken at line 5-5 of FIG. 4, in accordance with an embodiment of the disclosure. The rear cap 108 may include a first portion 302, a second portion 304, and a third portion 306. The third portion 306 may be a rear portion of the rear cap 108. Surface 432 may be disposed on an end of the third portion 306 and may be a surface for the back end member 106 to bottom against when the back end member 106 is coupled to the rear cap 108 (and, thus, prevent further threading of the back end member 106 relative to the rear cap 108). The third portion 306 may be a portion with an outer diameter larger than the second portion 304 and the first portion 302.

The second portion 304 may include threads 408 that are configured to engage corresponding threads of the back end member 106. The surface 414 may be disposed on an end (e.g., the forward end) of the second portion 304. The surface 414 may be configured to receive an end of the coil spring 112. The second portion 304 may include a larger outer diameter than the first portion 302.

The first portion 302 may be disposed forward of the second portion 304. The first portion 302 may include the flange 422. The flange 422 may include the first flange portion 424, which may be a substantially straight portion, and the second flange portion 430. The second flange portion 430 may be a sloped portion that forms a lead in surface to allow compressed coils of the coil spring 112 to ride over the flange 422. Such a configuration may allow for smooth compression of the coil spring 112.

Figure 9:
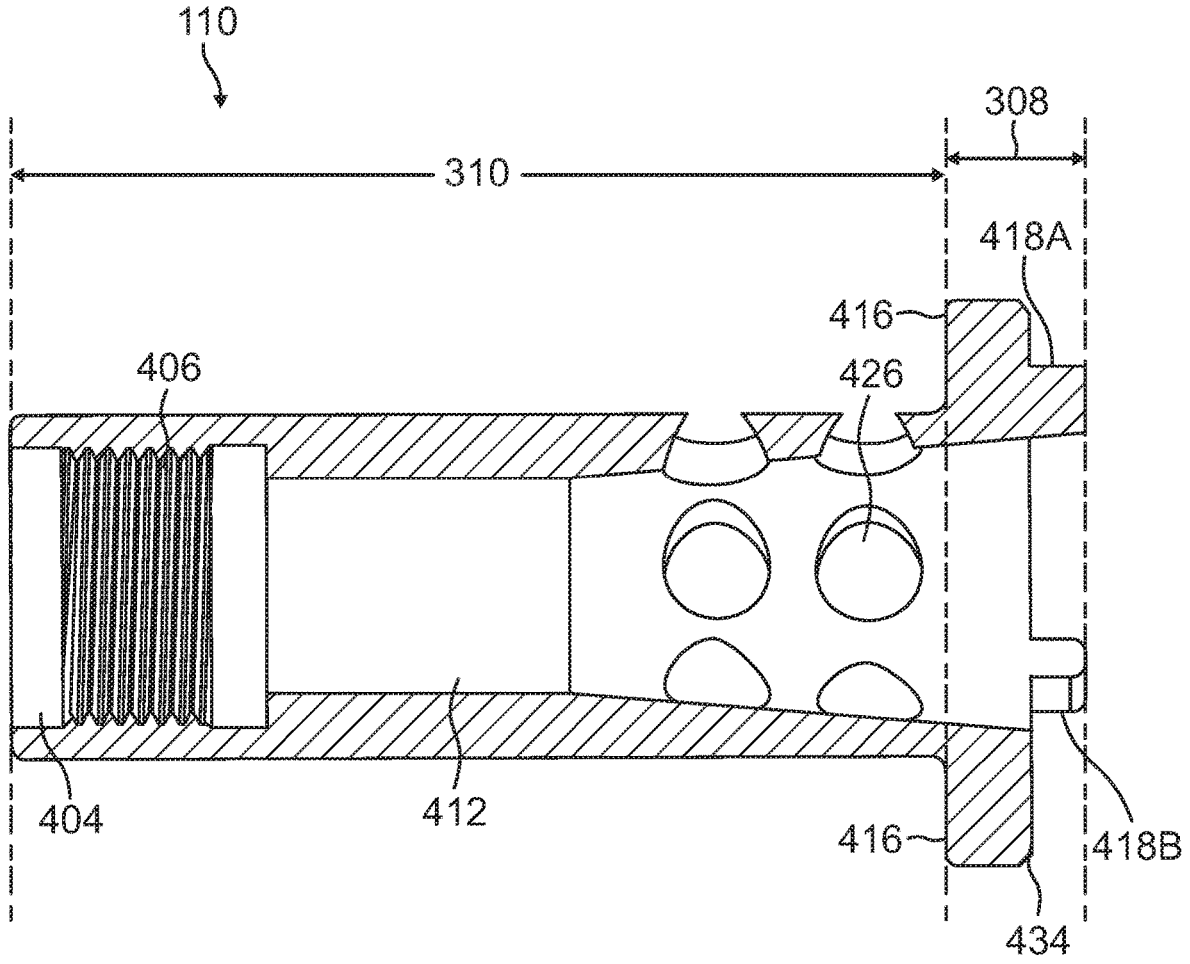
FIG. 9 illustrates a cross-sectional view of a piston of a recoil booster, taken at line 5-5 of FIG. 4, in accordance with an embodiment of the disclosure.

FIG. 9 illustrates a cross-sectional view of a piston of a recoil booster, taken at line 5-5 of FIG. 4, in accordance with an embodiment of the disclosure. Piston 110 may include a first piston portion 308 and a second piston portion 310. The first piston portion 308 may be disposed on a forward portion of the piston 110 while the second piston portion 310 may be disposed on a rearward portion of the piston 110.

Surface 416 may be disposed on a rearward end of the first piston portion 308 and/or on a forward end of the second piston portion 310. The surface 416 may be configured to receive an end of the coil spring 112 (e.g., the opposite end received by the surface 414).

Opening 404 may be disposed on the rearward portion of the second piston portion 310 and may include threads 406. The threads 406 may engage corresponding threads of a firearm or attachment mechanism to couple the suppressor 100 to the firearm. The opening 404 may also include a bottoming ridge to prevent over-threading.

Piston 110 may further include apertures 426 that allows for gasses to flow from the central aperture 412 to outside the piston 110, or vice versa as well as tabs 418A and 418B (and other tabs). Tabs 418A and 418B may be disposed within corresponding openings of the suppressor 100 to orient the piston 110.

Figure 10:
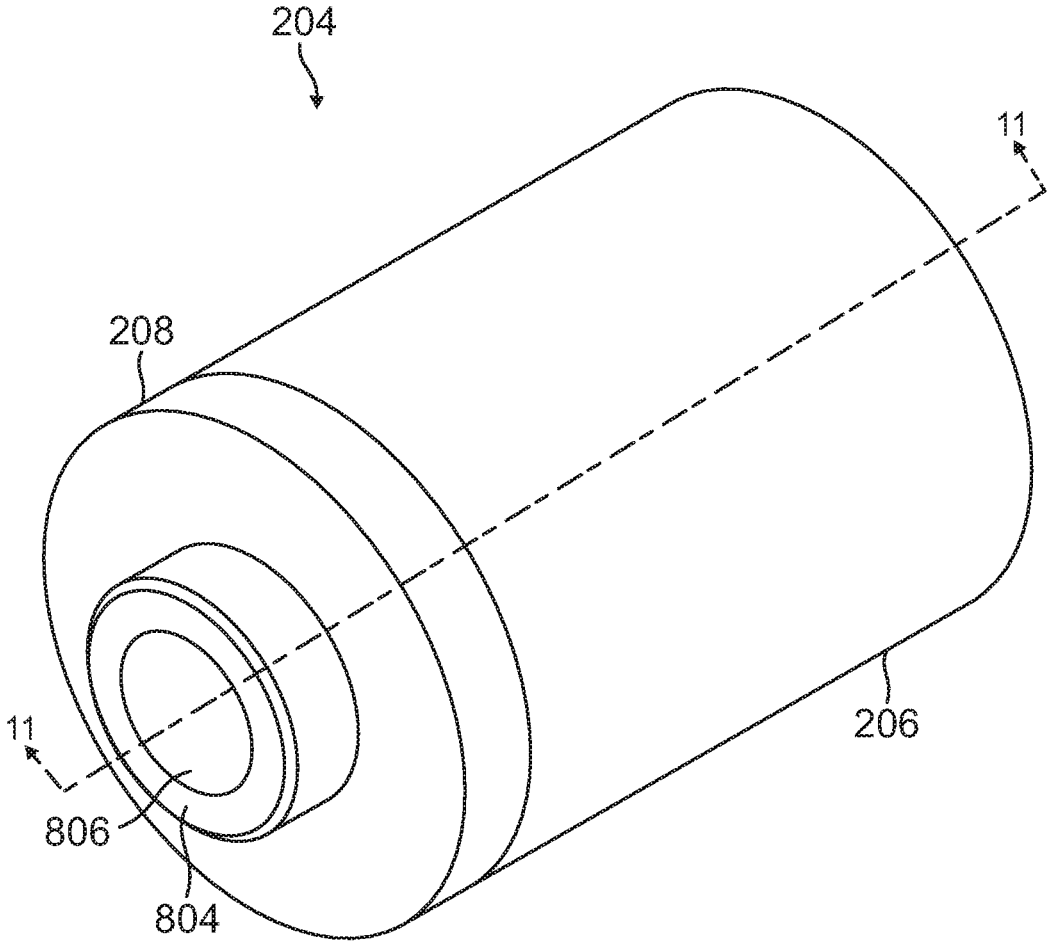
FIG. 10 illustrates a view of a portion of a firearm sound suppressor including a recoil booster in accordance with embodiments of the disclosure.
Figure 11:
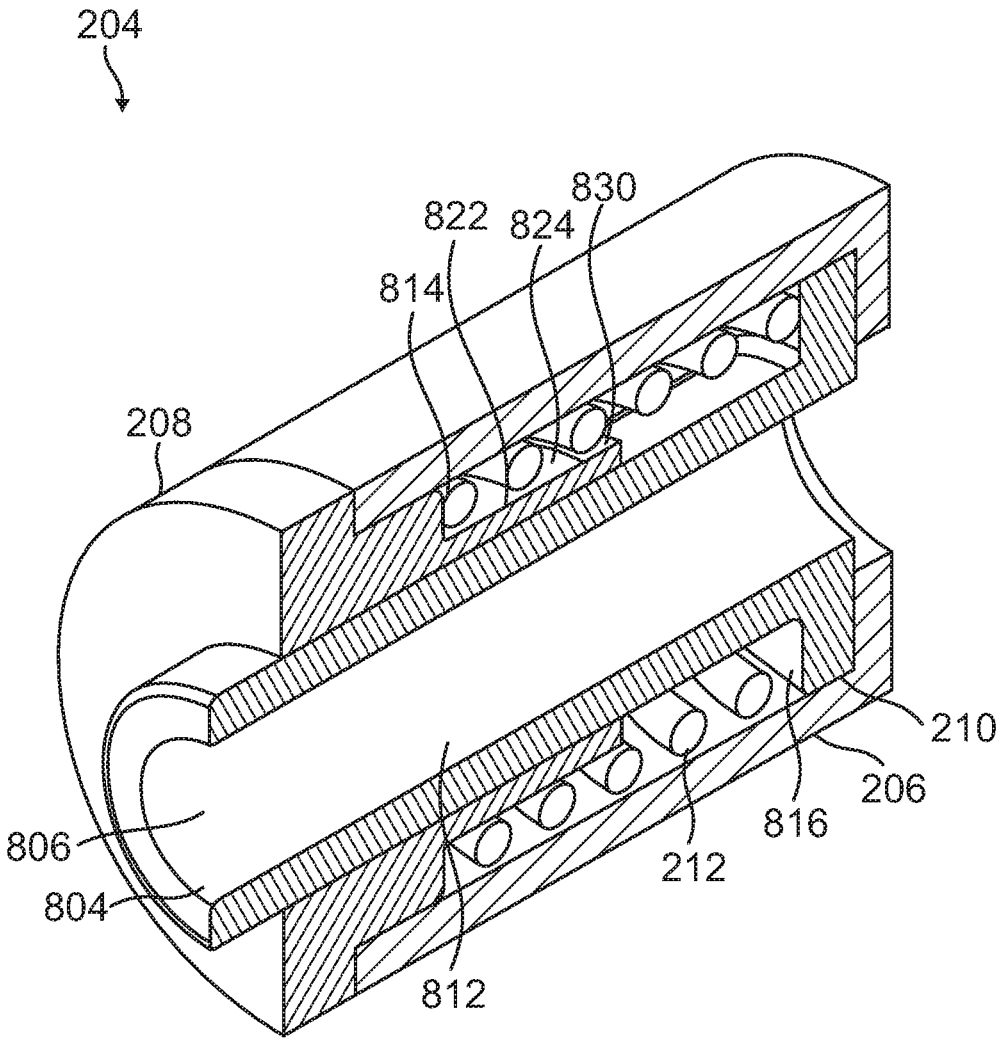
FIGS. 11-13 illustrate cross-sectional views of a portion of a firearm sound suppressor including a recoil booster, taken at line 11-11 of FIG. 10, in accordance with embodiments of the disclosure.
Figure 12:
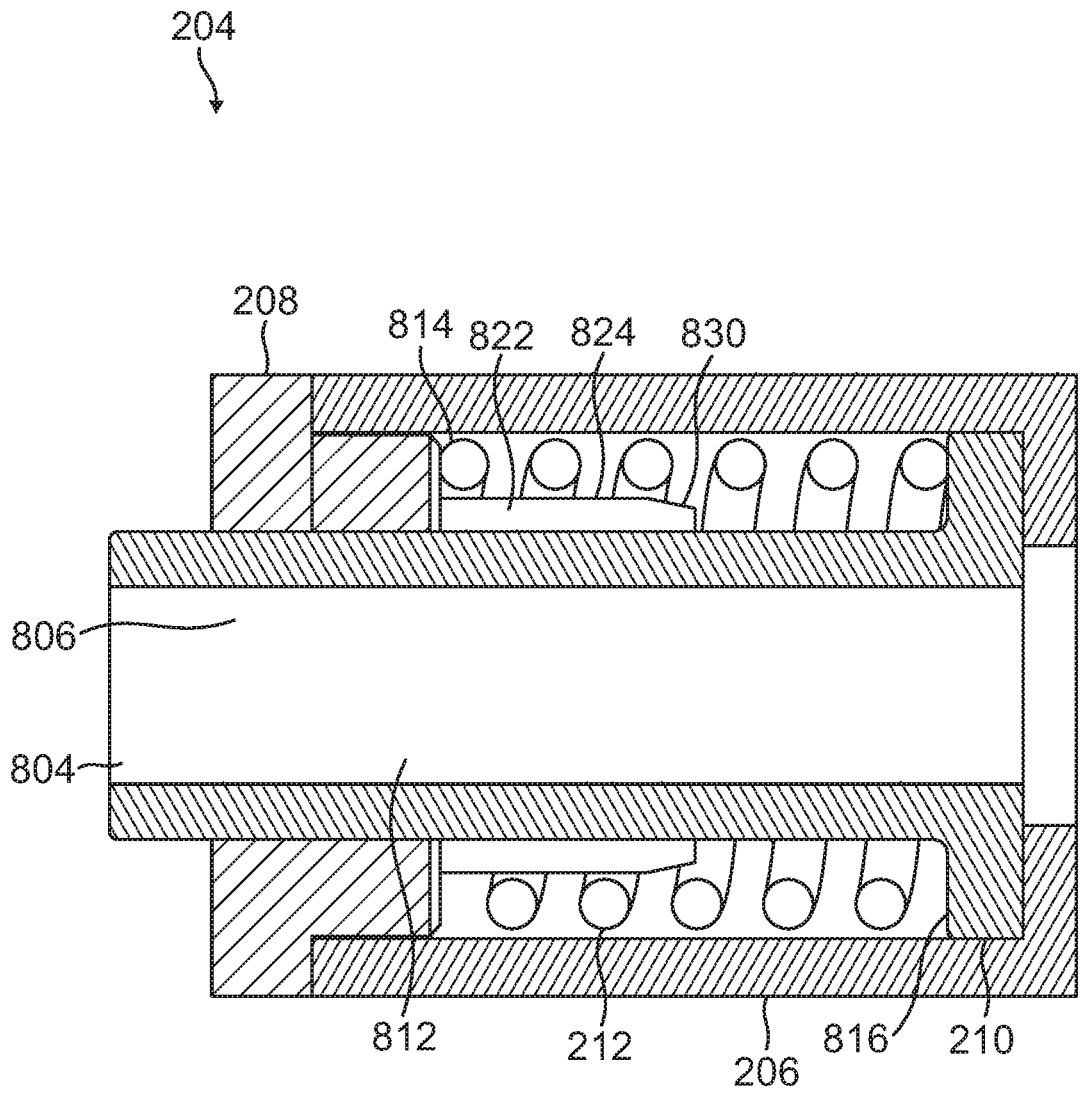
Figure 13:
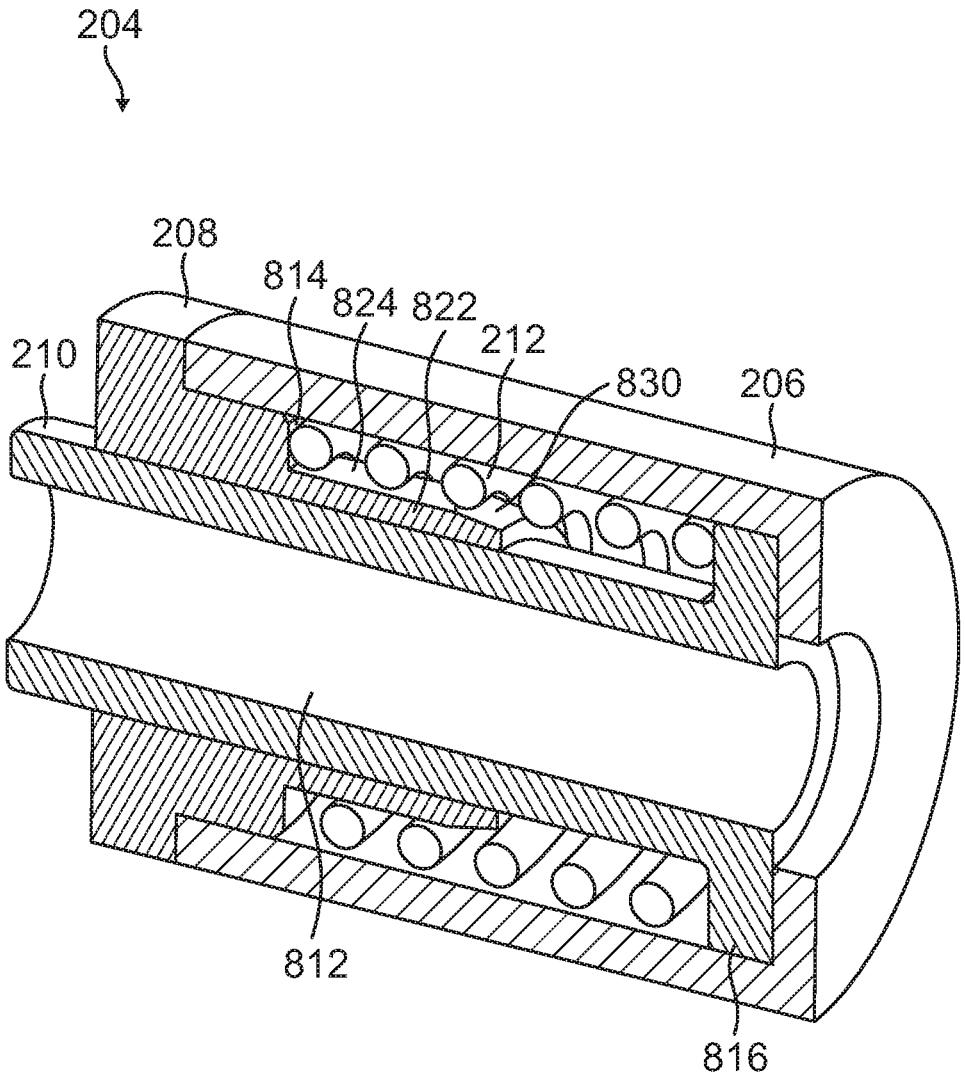

FIG. 10 illustrates a view of a portion of a firearm sound suppressor including a recoil booster in accordance with embodiments of the disclosure. FIGS. 11-13 illustrate cross-sectional views of a portion of a firearm sound suppressor including a recoil booster, taken at line 11-11 of FIG. 10, in accordance with embodiments of the disclosure. FIGS. 10-13 illustrate back end member 206 and recoil booster 204. Recoil booster 204 may include rear cap 208, piston 210, and coil spring 212. Though a coil spring is shown in the embodiments described herein, other embodiments may utilize other types of springs (e.g., spring, leaf, and/or other such springs) alternatively or additionally to coil springs.

Piston 210 may include an opening 804 configured to receive a portion of a muzzle of a firearm. Opening 804 may include a surface 806 where the muzzle may be disposed within. The piston 210 may be at least partially disposed within (e.g., radially inward) the rear cap 208. The rear cap 208 may include flange 822. The flange 822 may allow for the piston 210 to slide with greater stability relative to the rear cap 208.

Coil spring 212 may be disposed between portions of the back end member 206 and the rear cap 208 and/or the piston 210 and may bottom against surfaces 814 (of the rear cap 208) and 816 (of the piston 210). In certain embodiments, flange 822 may extend outward from a body of the rear cap 208 and may be disposed within an interior of the coil spring 212.

Figure 14:
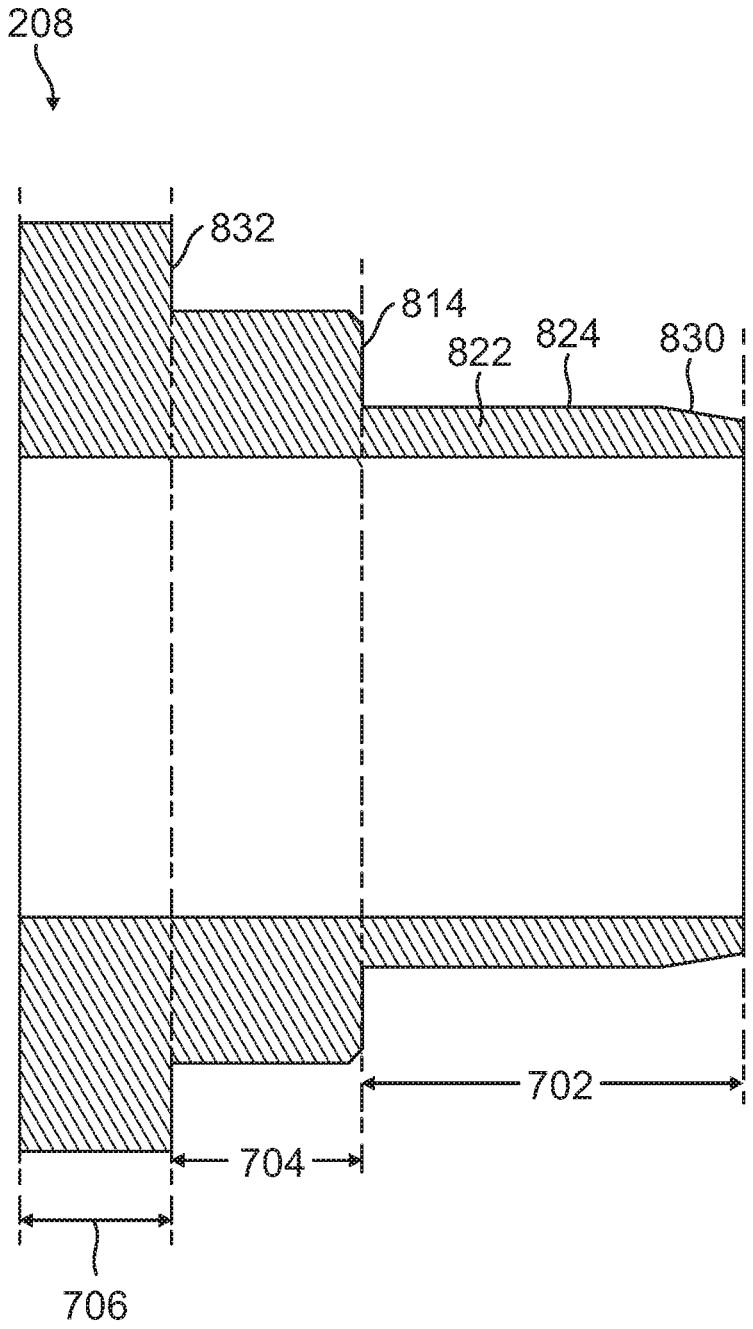
FIG. 14 illustrates a cross-sectional view of a rear cap of a recoil booster, taken at line 11-11 of FIG. 10, in accordance with an embodiment of the disclosure.

FIG. 14 illustrates a cross-sectional view of a rear cap of a recoil booster, taken at line 11-11 of FIG. 10, in accordance with an embodiment of the disclosure. As shown, the rear cap 208 may include a first portion 702, a second portion 704, and a third portion 706. The third portion 706 may be disposed rearward of and may include a larger outer diameter than the second portion 704. The second portion 704 may be disposed rearward of and may include a larger outer diameter than the first portion 702.

The first portion 702 may include the flange 822. The flange 822 may include a first flange portion 824 and a second flange portion 830. The first flange portion 824 may be substantially straight while the second flange portion 830 may be sloped, be disposed forward of the first flange portion 824, and configured to serve as a lead-in for the coils of the coil spring 212. Additionally, the flange 822 may extend over the piston 210 to provide a larger bearing area to improve positioning of the piston 210 relative to the rear cap 208.

Figure 15:
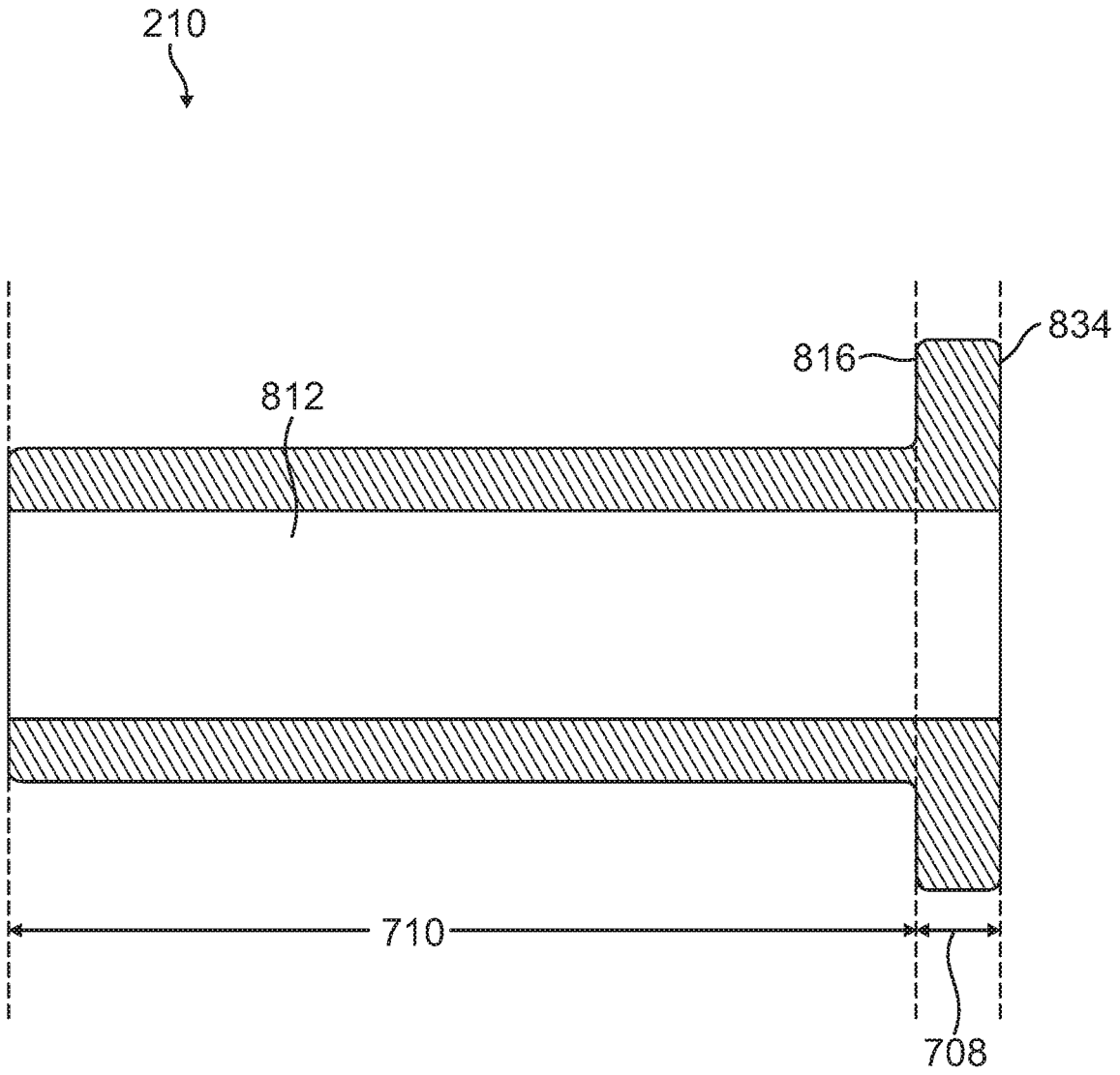
FIG. 15 illustrates a cross-sectional view of a piston of a recoil booster, taken at line 11-11 of FIG. 10, in accordance with an embodiment of the disclosure.

FIG. 15 illustrates a cross-sectional view of a piston of a recoil booster, taken at line 11-11 of FIG. 10, in accordance with an embodiment of the disclosure. The piston 210 may include a first piston portion 708 and a second piston portion 710. The first piston portion 708 may include a larger outer diameter than the second piston portion 710. The larger first piston portion 708 may include a surface 816 for the coil spring 212 to bottom against and a surface 834 configured to bottom against the back end member 206. Central aperture 812 may be disposed within the piston 210 to allow a projectile (e.g., bullet) to pass.

Figure 16:
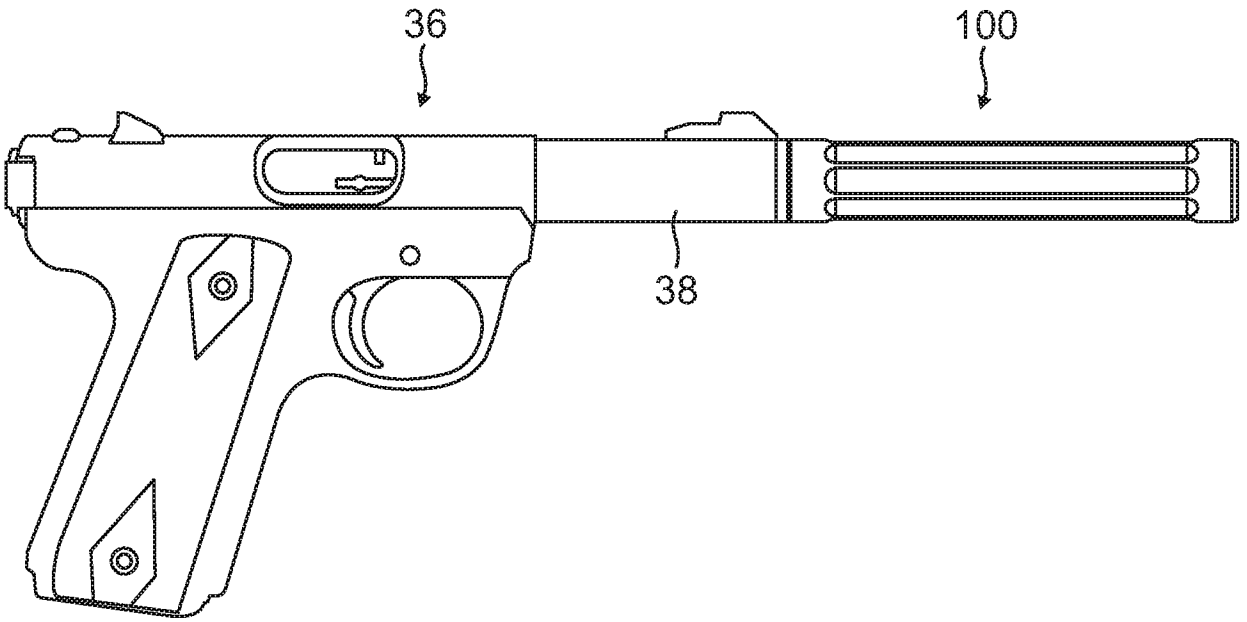
FIG. 16 illustrates a firearm with a firearm sound suppressor attached thereto in accordance with an embodiment of the disclosure.

FIG. 16 illustrates a firearm with a firearm sound suppressor attached thereto in accordance with an embodiment of the disclosure. FIG. 16 illustrates the suppressor 100 coupled to the muzzle end of the barrel 38 of a firearm 36. In several embodiments, the suppressor 100 may be used with various types of weapons such as, for example, automatic or semiautomatic pistols, rifles, or other types of weapons. It should be understood that the suppressor 100 can be used with firearms of different calibers and of different types, such as semiautomatic or fully automatic machine pistols or rifles.

In certain embodiments, the firearm 36 can be operated with the suppressor 100. A projectile can be fired by the firearm 36 that can travel through the central aperture 412 and then through the central lumen 122. Firing of the projectile can produce a force. The force may be received by the suppressor 100 (e.g., by the piston 110 of recoil booster 104). The force may cause the piston 110 to move (e.g., slide) relative to other portions of the suppressor 100, such as relative to the rear cap 108. By allowing the piston 110 to move relative to the other portions of the suppressor 100, the weight of the suppressor 100 is accordingly de-coupled from the barrel 38, allowing for the barrel 38 to properly recoil and cycle the firearm 36.

Movement of the piston 110 may compress the coil spring 112. After the piston 110 has moved and the firearm 36 has cycled, force from compression of the coil spring 112 then move the piston 110 back to its original starting position relative to other portion of the suppressor 100.

The disclosure is not intended to limit the present invention to the precise forms or particular fields of use disclosed. It is contemplated that various alternate embodiments and/or modifications to the present invention, whether explicitly described or implied herein, are possible in the suppressor of the disclosure. For example, it is contemplated that the various embodiments set forth herein may be combined together and/or separated into additional embodiments where appropriate.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims

What is claimed is:

1. A firearm sound suppressor comprising:

a housing;

a back end member coupled to the housing; and a recoil booster coupled to the back end member and configured to couple to a firearm, wherein the recoil booster comprises:

a coil spring, a rear cap coupled to the back end member and comprising:

a main body at least partially disposed within the back end member and comprising a first bearing surface to receive a first end of the spring, and a flange extending forward from the main body and maintained within an inner circumference of the spring, wherein the flange comprises a substantially straight first flange portion and a sloped second flange portion forward of the first flange portion and wherein the sloped second flange portion is configured to guide a portion of the spring over the flange as the spring compresses in response to a firing of the firearm, and a piston configured to slide relative to the rear cap and comprising a second bearing surface configured to receive a second end of the spring.

2. The firearm sound suppressor of claim 1, wherein the spring is configured to compress between the first and second bearing surfaces in response to a firing of the firearm, and wherein the flange is configured to separate at least a portion of the spring from a longitudinal surface of the piston before and during the firing.

3. The firearm sound suppressor of claim 1, wherein the main body of the rear cap comprises:

a first portion having a first diameter disposed within the back end member and comprising the first bearing surface; and a second portion having a second larger diameter disposed behind and abutting the back end member.

4. The firearm sound suppressor of claim 1, wherein the piston comprises threads configured to couple the recoil booster to the firearm.

5. The firearm sound suppressor of claim 1, further comprising a seal disposed between the rear cap and the piston.

6. The firearm sound suppressor of claim 1, further comprising a void disposed between the rear cap and the piston.

7. The firearm sound suppressor of claim 1, wherein the coil spring is disposed within a lumen, and wherein the lumen is at least partially defined by at least portions of the rear cap, the piston, and the back end member.

8. The firearm sound suppressor of claim 7, wherein the piston comprises a central aperture configured to allow a bullet to pass, and wherein the piston comprises an opening configured to allow gases to pass between the central aperture and the lumen.

9. The firearm sound suppressor of claim 1, wherein the piston comprises one or more tabs, wherein the back end member comprises one or more openings configured to receive the one or more tabs, and wherein the back end member is configured to orient the piston when the one or more openings receive the one or more tabs.

10. A method of operating a firearm sound suppressor, the method comprising:

receiving a force from a firearm with a piston of a recoil booster of the firearm sound suppressor, wherein the firearm sound suppressor comprises:

a housing, a back end member coupled to the housing, and the recoil booster coupled to the back end member and coupled to a firearm, wherein the recoil booster comprises:

a coil spring, a rear cap coupled to the back end member and comprising:

a main body at least partially disposed within the back end member, wherein the main body comprises a first bearing surface to receive a first end of the spring, a flange extending forward from the main body and maintained within an inner circumference of the spring, wherein the flange comprises a substantially straight first flange portion and a sloped second flange portion forward of the first flange portion and wherein the sloped second flange portion is configured to guide a portion of the spring over the flange as the spring compresses in response to a firing of the firearm, and the piston configured to slide relative to the rear cap and comprising a second bearing surface configured to receive a second end of the spring;

sliding the piston, relative to the rear cap of the recoil booster, from a first position to a second position to compress the coil spring of the recoil booster; and returning the piston to the first position with force from the compressed coil spring.

11. The method of claim 10, wherein the flange is configured to separate at least a portion of the spring from a longitudinal surface of the piston before and during a firing of the firearm.

12. The method of claim 10, wherein the main body of the rear cap comprises:

a first portion having a first diameter disposed within the back end member and comprising the first bearing surface; and a second portion having a second larger diameter disposed behind and abutting the back end member.

13. The method of claim 10, wherein the piston comprises threads configured to couple the recoil booster to the firearm.

14. The method of claim 10, wherein the firearm sound suppressor further comprises a seal disposed between the rear cap and the piston.

15. The method of claim 10, wherein the firearm sound suppressor further comprises a void disposed between the rear cap and the piston.

16. The method of claim 10, wherein the coil spring is disposed within a lumen, wherein the lumen is at least partially defined by at least portions of the rear cap, the piston, and the back end member, and wherein the piston comprises a central aperture configured to allow a bullet to pass, and wherein the method further comprises:

allowing gases to pass between the central aperture and the lumen through an opening of the piston.

17. The method of claim 10, wherein the piston comprises one or more tabs, wherein the back end member comprises one or more openings configured to receive the one or more tabs, and wherein the method further comprises:

orienting the piston relative to the back end member by receiving the one or more tabs within the one or more opening.

18. A method of manufacturing a firearm sound suppressor, the method comprising:

providing a housing;

coupling a back end member to the housing; and coupling a recoil booster to the back end member, wherein the recoil booster is configured to couple to a firearm, and wherein the recoil booster comprises:

a coil spring, a rear cap coupled to the back end member and comprising:

a main body at least partially disposed within the back end member and comprising a first bearing surface to receive a first end of the spring, and a flange extending forward from the main body and maintained within an inner circumference of the spring, wherein the flange comprises a substantially straight first flange portion and a sloped second flange portion forward of the first flange portion and wherein the sloped second flange portion is configured to guide a portion of the spring over the flange as the spring compresses in response to a firing of the firearm, and a piston configured to slide relative to the rear cap and comprising a second bearing surface configured to receive a second end of the spring.

* * * * *